US011498593B2

(12) United States Patent
Warrington et al.

(10) Patent No.: US 11,498,593 B2
(45) Date of Patent: Nov. 15, 2022

(54) RAILCAR BALLAST DELIVERY GATE

(71) Applicant: LORAM TECHNOLOGIES, INC., Georgetown, TX (US)

(72) Inventors: Matthew Warrington, Helena, MT (US); Tracy Leibbrandt, Clancy, MT (US)

(73) Assignee: Loram Technologies, Inc., Georgetown, TX (US)

( * ) Notice: Subject to any disclaimer, the term of this patent is extended or adjusted under 35 U.S.C. 154(b) by 476 days.

(21) Appl. No.: 16/782,161

(22) Filed: Feb. 5, 2020

(65) Prior Publication Data

US 2020/0255037 A1 Aug. 13, 2020

Related U.S. Application Data

(60) Provisional application No. 62/803,520, filed on Feb. 10, 2019.

(51) Int. Cl.
*B61D 7/02* (2006.01)
*E01B 27/02* (2006.01)

(52) U.S. Cl.
CPC ..... *B61D 7/02* (2013.01); *E01B 27/022* (2013.01)

(58) Field of Classification Search
CPC ... B61D 7/02; B61D 7/04; B61D 7/06; B61D 7/16; B61D 7/18; B61D 7/24; B61D 7/26; B61D 7/28; E01B 27/022; E01B 27/023
See application file for complete search history.

(56) References Cited

U.S. PATENT DOCUMENTS

| | | | | |
|---|---|---|---|---|
| 4,628,825 | A | 12/1986 | Taylor et al. | |
| 5,038,966 | A | 8/1991 | Olk | |
| 5,657,700 | A * | 8/1997 | Bounds | B61D 7/30 104/2 |
| 6,431,084 | B1 * | 8/2002 | Gaydos | B61D 7/20 105/247 |
| 6,637,346 | B2 | 10/2003 | Gaydos | |
| 7,152,347 | B2 | 12/2006 | Herzog et al. | |
| 7,252,039 | B1 * | 8/2007 | Bosshart | B61D 7/32 105/256 |
| 7,806,057 | B2 | 10/2010 | Early | |
| 7,814,842 | B2 | 10/2010 | Early | |
| 9,346,473 | B1 | 5/2016 | Herzog et al. | |
| 2003/0015117 | A1 | 1/2003 | Gaydos | |
| 2005/0278982 | A1 * | 12/2005 | Herzog | E01B 27/02 37/104 |

(Continued)

*Primary Examiner* — Robert J McCarry, Jr.
(74) *Attorney, Agent, or Firm* — Parsons Behle & Latimer

(57) ABSTRACT

A railcar ballast delivery gate with first and second parallel side walls spaced apart by a center truss plate that extends between and is perpendicular to each of the two side walls, a center angled bar that straddles the center truss plate, first and second primary elongated tubes extending between the first and second side walls on opposing sides of the side walls, and a divider assembly. The primary elongated tubes are rotatably connected to first and second tube arms, which in turn are fixedly couple to first and second secondary elongated tubes that are configured to move relative to the primary elongated tubes while remaining parallel to them. The tube arms are rotatably connected to door linkages that are situated underneath and fixedly attached to door panels resting on trusses that extend from a center truss plate.

6 Claims, 15 Drawing Sheets

(56) References Cited

U.S. PATENT DOCUMENTS

| | | | |
|---|---|---|---|
| 2009/0007813 | A1 | 1/2009 | Early |
| 2010/0107924 | A1 | 5/2010 | Early |
| 2015/0000555 | A1 | 1/2015 | Klinkenberg et al. |
| 2016/0121909 | A1 | 5/2016 | Herzog |
| 2018/0186387 | A1 | 7/2018 | Richmond |

* cited by examiner

RAILCAR BALLAST DELIVERY GATE

CROSS-REFERENCE TO RELATED APPLICATION

This application claims priority back to U.S. Patent Application No. 62/802,520 filed on Feb. 10, 2019, the contents of which are incorporated herein by reference.

BACKGROUND OF THE INVENTION

1. Field of the Invention

The present invention relates generally to the field of railcars, and more particularly, to a low-profile railcar ballast delivery gate that minimizes the force required to open and close the doors of the gate through the use of hydraulic actuators and a large leverage arm.

2. Description of the Related Art

Railroad companies use ballast cars to deliver rail ballast. Several types of ballast cars exist on the market. Most cars dump the ballast through gates or doors that are located on the underside of the ballast car, and the present invention is designed to be used with this type of railcar. Existing ballast delivery systems range from manually operated older models to fully automated high-speed dumping systems. The present invention solves several problems presented by existing systems; namely, the present invention provides a system that is robust, reliable and operational in adverse conditions. It is relatively inexpensive to manufacture and can act as a direct replacement for outdated systems with minimal conversion cost.

Ballast is typically used to form the track bed upon which the railroad ties are laid. The ballast bears the load from the railroad ties, facilitates water drainage, and prevents vegetation from growing where it might interfere with the track structure. Ballast may also need to be conveyed from the railcar to a location other than the track bed for stockpiling or transportation purposes. Conventional ballast gates are not optimized for these purposes. As will become apparent from the detailed description of the invention below, the present invention is different structurally from any of the prior art inventions described below.

U.S. Pat. No. 4,628,825 (Taylor et al., 1986) discloses an actuating mechanism for operating sliding gates of a railway hopper car that opens all of the gates simultaneously. A shifting means coupled to each gate by means of pivoted levers moves some gates in one direction to an open position, while at least one gates moves to its open position in the opposing direction. The mechanism that shifts all of the gates simultaneously is activated from a single power source. The invention operates by virtue of a plurality of drive levers that couple the shifting means to the sliding gates. The invention does not pertain to a single gate system but rather a mechanism for coordinating the opening and closing of multiple gates at once.

U.S. Pat. No. 5,038,966 (Olk, 1991) provides a hopper door closure comprised of a door and a frame assembly that attaches to the bottom of the hopper. The frame assembly includes a door frame and a cross-piece which, together with the side walls and one of the end walls, defines the hopper outlet opening. A door is slidably mounted to the frame, and a door moving device slides the door between an open and a closed position. The invention is not specific to the type of door moving device, and actuation may be effectuated with air or hydraulic cylinders, an electric motor using a rack-and-pinion system, or manually with a chain or cable.

U.S. Pat. No. 6,431,084 (Gaydos, 2002) discloses a railroad hopper car gate assembly comprising a frame that is attached to the underside of a hopper body directly underneath the car outlet and a door assembly. Each gate assembly includes inner and outer door assemblies, and each door assembly is mounted for generally vertical sliding movements. Linkages at opposed ends of the door assembly operate the inner and outer door assemblies via a pair of reversible electromechanical drivers. The electric drivers purportedly impart a substantially constant speed to and during movement of the door assemblies between their open and closed positions and regardless of the load placed upon them by the ballast in the hopper.

U.S. Pat. No. 6,637,346 (Gaydos, 2003) is a continuation of the '084 patent discussed above. The present invention is advantageous over the gate described in the '084 and '346 patent because the latter does not provide sufficient clearance between the top of the rail and the bottom of the door to allow a conveyor designed to carry aggregate to fit therethrough. The '346 patent covers a method for controlling the distribution of ballast to a track bed using electromechanical reversible drivers and a controller operated by a remote control apparatus, the controller being operably coupled to one or more of a series of manual actuators mounted on the hopper car. The invention is not designed to allow the ballast to be dumped anywhere other than on the rail bed and, therefore, is not a low-profile gate.

U.S. Pat. No. 7,152,347 (Herzog et al., 2006) provides a method and apparatus for spreading ballast along railways. The method includes the use of an inertial measurement system to determine where to apply ballast from the hopper car. The invention is not specific to the gate design but rather focuses on determining the location and speed of the ballast spreading train using a variety of manual or automated visual techniques, laser technology, radar technology, radio frequency transponders, magnetic sensors, thermal imaging and aerial photogrammetry.

U.S. Pat. No. 7,252,039 (Bosshart, 2007) discloses a ballast discharge car with a non-pivoting transverse conveyor disposed beneath the hopper for distributing the ballast between the rails, near the outside of the rails, and beyond the outside of the rails. The speed, direction and angle of the conveyor is adjustable so that the ballast can be selectively cast in a wide range of distances from the outside of the rails. This invention focuses on the conveyor mechanism and not on the gate itself.

U.S. Pat. No. 7,806,057 (Early, 2010) provides a hopper car gate with opposed double doors for discharging ballast from a hopper car. First and second doors are supported on a rail that extends between opposite walls adjacent to the bottom opening of the gate. The doors move strictly horizontally via a gear rack mounted to the bottom surface of the door.

U.S. Pat. No. 7,814,842 (Early, 2010) discloses a hopper car gate with a laterally opening door in which the length of the door is greater than its width. The door is supported on a rail that extends between the side walls adjacent to the bottom opening of the gate. The door is movable only in a direction that is perpendicular to the length of the hopper car to which the gate is joined.

U.S. Pat. No. 9,346,472 (Herzog et al., 2016) provides a material transport and distribution consist (set of railroad vehicles) including an offloading car, a generator car, and hopper cars. The offloading car includes a rotatable conveyor configured to offload materials forward of and to the sides of the car. The hopper cars include a longitudinal conveyor that is configured to enable the transport of materials between cars and while the cars are negotiating a turn in the tracks. The invention includes a control system that manages the gates and conveyors during offloading based on sensed characteristics of the operations thereof. The hopper cars comprise angled sidewalls and transverse dividers that divide the lower part of the hopper into a series of chutes overlying the center of the hopper conveyor. A hopper gate is situated on the lower end of each chute and includes a base frame and a slide plate. The slide plate moves horizontally across the bottom of the gate, and the leading edge of the slide plate contacts a resilient panel, which allows flexure between the slide plate and the chute extension.

U.S. Patent Application Pub. No. 2015/0000555 (Klinkenberg el al.) discloses a discharge assembly for a bulk materials rail wagon with a movable closure assembly. The discharge assembly has a base comprised of two discrete frames interconnected by an actuation assembly. Each frame includes longitudinal and transverse frame elements and intermediate guide members that extend between the longitudinal frame elements and are spaced apart from one another to form openings. The discharge assembly further comprises closure members movably mounted on the frame, the closure members being movable between a closed position and an open position by the actuating assembly. The movement of the closure members is by translation along the longitudinal frame elements.

U.S. Patent Application Pub. No. 2018/0186387 (Richmond) provides a hopper care with a low-height gate. This gate is gear-driven, and the doors move in the longitudinal direction of the hopper car. The sloping interior walls of the hopper form a ridge. The ridge forms two sloping edges between adjacent discharge gates. One of the objects of this invention was to eliminate the necessity of a center sill to support the longitudinal doors. The invention involves the use of multiple low-height discharge gates, as opposed to a single large discharge gate of a conventional hopper, with a plurality of smaller ridges rather than the tall ridge of conventional hopper cars.

BRIEF SUMMARY OF THE INVENTION

The present invention is a railcar ballast delivery gate comprising: first and second parallel side walls spaced apart by a center truss plate that extends between and is perpendicular to each of the two side walls; a center angled bar that straddles the center truss plate and extends between the first and second side walls; first and second primary elongated tubes extending between the first and second side walls on opposing sides of the side walls; and a divider assembly; wherein the center truss plate and center angled bar are situated in between and parallel to the first and second primary elongated tubes; wherein the first and second primary elongated tubes are on the same horizontal plane; wherein the first and second primary elongated tubes each has a length, and the length of the first primary elongated tube is the same as the length of the second primary elongated tube; wherein each of the first and second primary elongated tubes is rotatably connected to a first tube arm on a first end of the primary elongated tube and rotatably connected to a second tube arm on a second end of the elongated primary tube; wherein the first tube arm is fixedly coupled to a first secondary elongated tube that is parallel to the first primary elongated tube; wherein the second tube arm is fixedly coupled to a second secondary elongated tube that is parallel to the second primary elongated tube; wherein the first and second secondary elongated tubes each has a length, and the length of the first secondary elongated tube is the same as the length of the second secondary elongated tube; wherein the length of the first and second secondary elongated tubes is greater than the length of the first and second primary elongated tubes; wherein the first and second secondary elongated tubes are configured to move relative to the first and second primary elongated tubes while remaining parallel to the first and second primary elongated tubes; wherein each of the first and second tube arms is rotatably connected to a door linkage that is situated underneath and fixedly attached to a door panel; wherein each of the door panels is slidably situated on top of a plurality of trusses that are perpendicular to and extend outwardly from the center truss plate; wherein each truss is angled downwardly from a center of the truss so that the door panels tilt upward as they rest upon the plurality of trusses; wherein a first end of each secondary elongated tube is rotatably coupled to a hydraulic cylinder situated on an exterior side of the first side wall; and wherein each hydraulic cylinder is rotatably attached to one of the first and second secondary elongated tubes via a cylinder arm.

In a preferred embodiment, each truss is joined at the center of the truss to the center truss plate; each truss has a first outer end and a second outer end; the first outer end of each of the trusses is joined to a first exterior plate that is situated downward of and exterior to the first primary elongated tube; the first secondary elongated arm is situated between the first primary elongated tube and the first exterior plate; the second outer end of each of the trusses is joined to a second exterior plate that is situated downward of and exterior to the second primary elongated tube; and the second secondary elongated arm is situated between the second primary elongated tube and the second exterior plate. In another preferred embodiment, each truss is a single piece of metal comprised of two truss arms; each truss arm comprises an elongated bottom leg, a top leg that is shorter than the bottom leg and situated on top of the bottom leg with a cutout configured to receive one of the first and second primary elongated tubes, and a joinder section that joins the top leg to the bottom leg; the top leg extends inwardly from the joinder section; the joinder section forms an outer end of the truss; the bottom leg is longer than the top leg; a slot is located between the top leg and the bottom leg and is configured to receive one of the two door panels; and the slot has a terminal end that is configured to act as a stop to prevent the door panel from sliding further downward when an outside edge of the door panel abuts up against the terminal end of the slot.

In a preferred embodiment, each of the first and second primary elongated tubes has an outwardly facing first surface and an inwardly facing second surface; the first surface and the second surface are at a ninety-degree angle relative to each other and at a forty-five-degree angle relative to a horizontal axis of the gate; a first inside slope plates extends downwardly from a bottom edge of the second surface at the same angle relative to the horizontal axis of the gate as the second surface and terminates above the bottom legs of the plurality of trusses, thereby forming a gap that is configured to receive an outside edge of one of the two door panels; the slope plate has an inside surface that rests against and is supported by angled edges on the top legs of the plurality of trusses; the angled edges of the top legs of the trusses are at a forty-five-degree angle relative to the slots in the plurality of trusses; and the inside slope plate is configured to form a continuous surface with the inwardly facing second surface of the first or second primary elongated tube. In another preferred embodiment, the divider assembly is comprised of two flat plates extending downwardly from a bottom edge of the center truss plate at a one hundred thirty-five-degree angle relative to a vertical axis of the center truss plate.

In a preferred embodiment, the invention further comprises first and second interior plates spaced apart from and connected to an inner surface of each of the first and second side walls, and a pair of door guides is situated on an inner surface of each of the first and second interior plates and configured to receive the door panels.

REFERENCE NUMBERS

Figure 1:
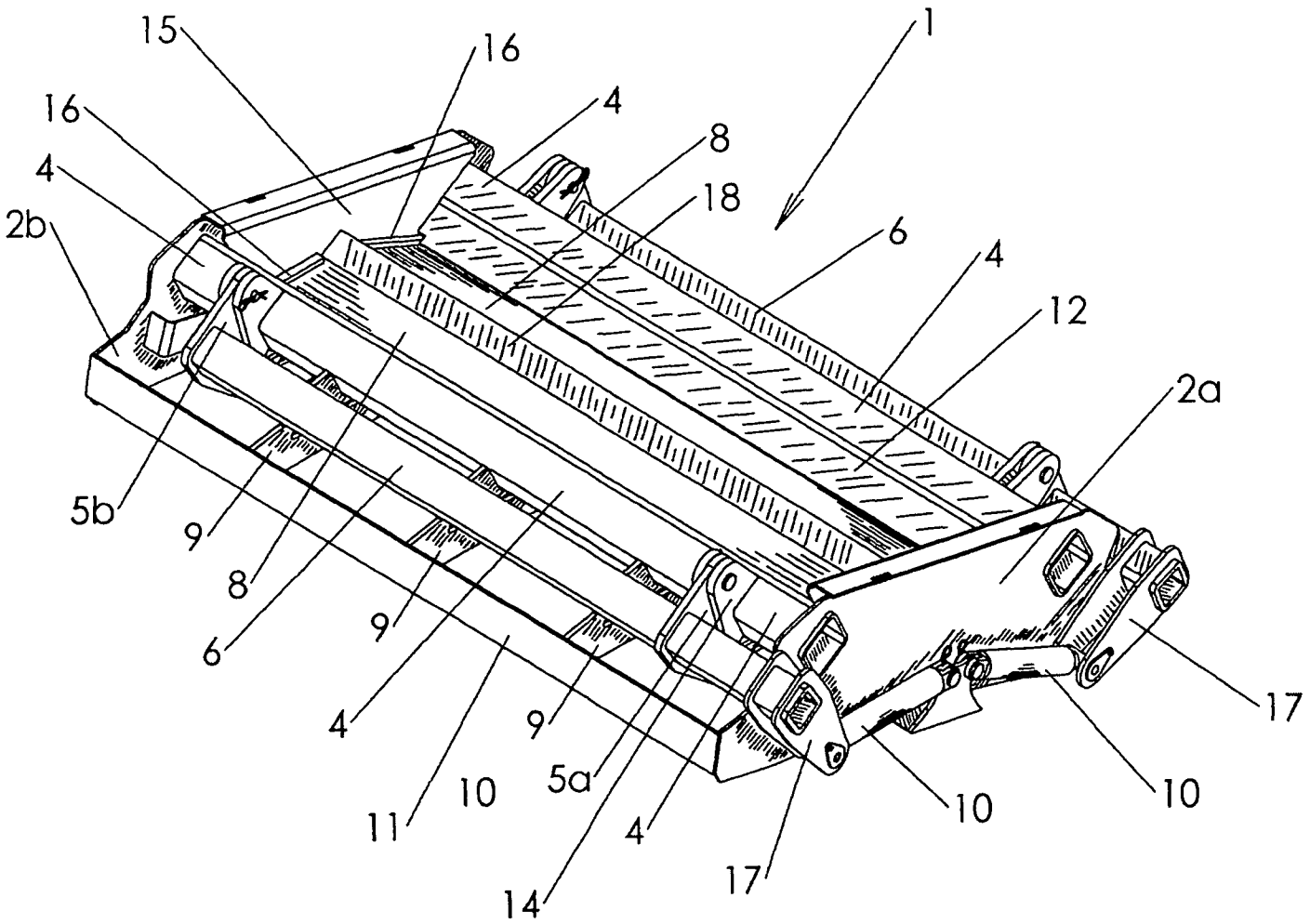
FIG. 1 is a first perspective view of the present invention shown with the gate panels closed.

1 Gate assembly
2*a* First side wall
2*b* Second side wall
3 Truss plate
3*a* Bottom edge (of truss plate)
4 Primary elongated tube
5*a* First tube arm
5*b* Second tube arm
6 Secondary elongated tube
7 Door linkage
7*a* Connecting member
8 Door panel
8*a* Outside edge (of door panel)
8*b* Inside edge (of door panel)
9 Truss
9*a* Bottom leg (of truss)
9*b* Top leg (of truss)
9*c* Cutout (in top leg of truss)
9*d* Joinder section (of truss)
9*e* Slot (in truss)
9*f* Terminal end (of slot)
9*g* Angled edge (of truss)
10 Hydraulic cylinder
11 Exterior plate
12 Inside slope plate
13 Divider assembly
13*a* First angled plate (of divider assembly)
13*b* Second angled plate (of divider assembly)
13*c* End plate (of divider assembly)
14 Pin gusset
15 Interior plate
16 Door guide
17 Cylinder arm
18 Center angled bar

DETAILED DESCRIPTION OF INVENTION

Figure 12:
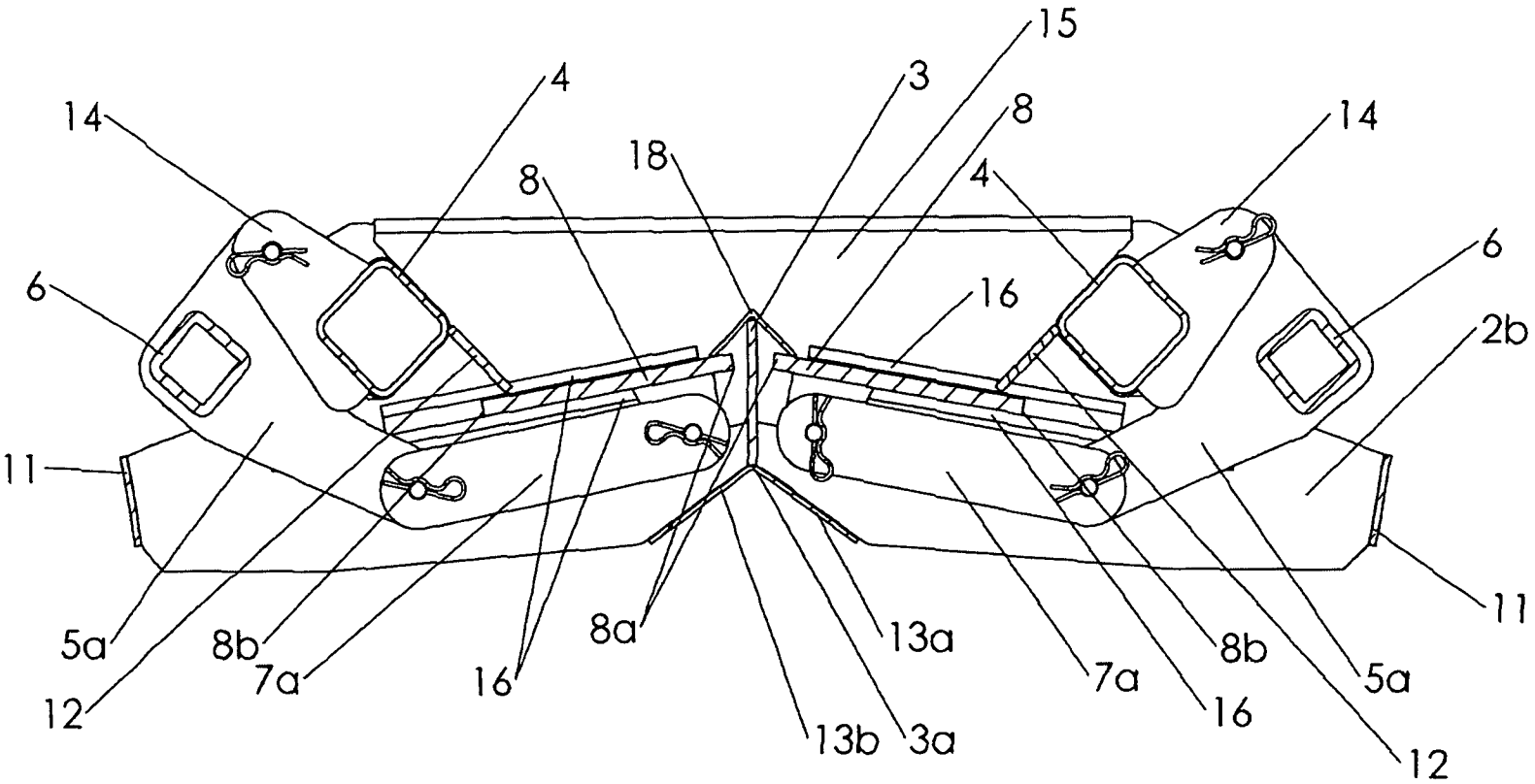
FIG. 12 is a side cross-section view of the present invention showing the mechanical arm assembly in a first position.
Figure 13:
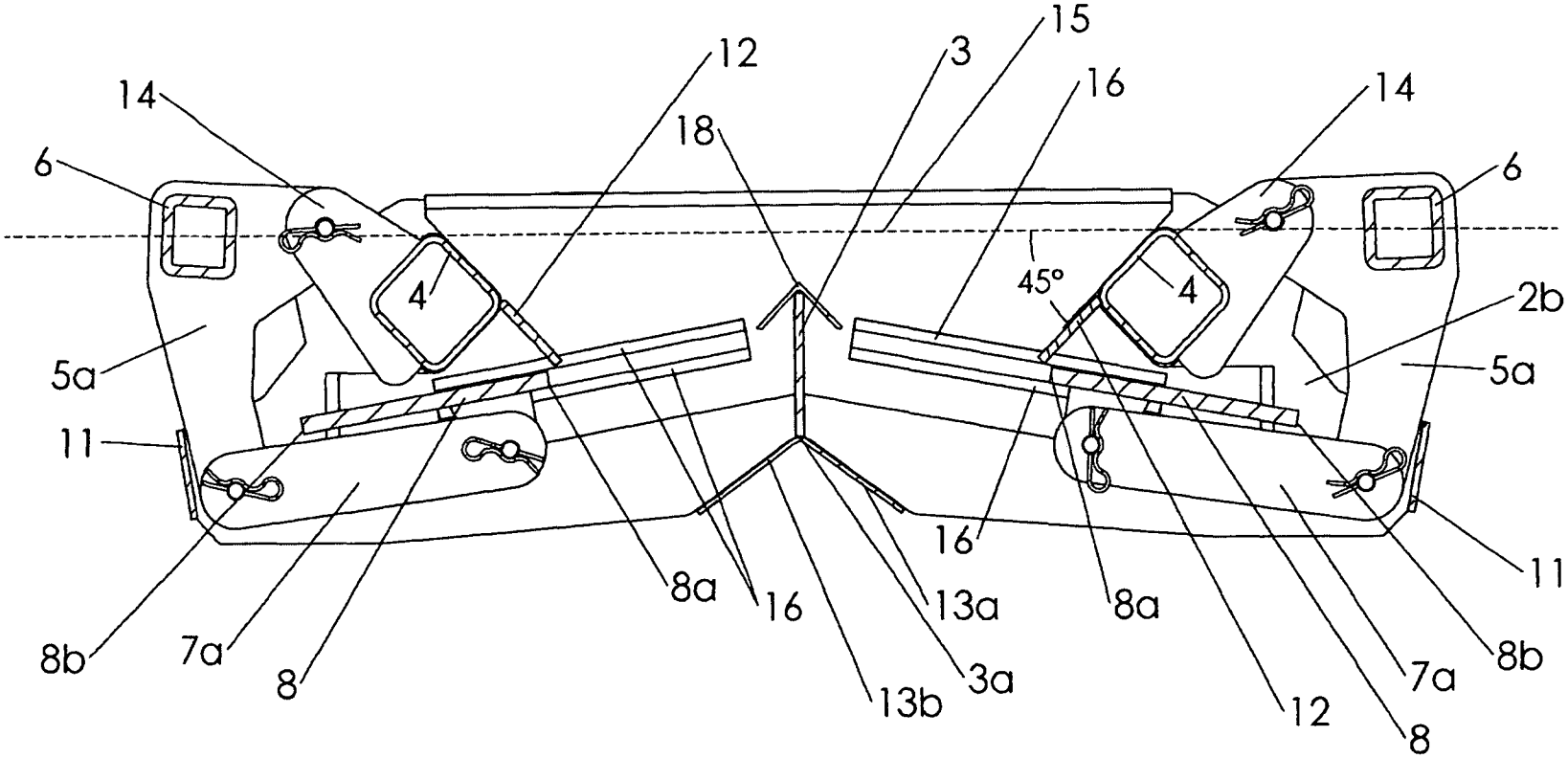
FIG. 13 is a side cross-section view of the present invention showing the mechanical arm assembly in a second position.

FIG. 1 is a first perspective view of the present invention shown with the gate panels closed. As shown in this figure, the gate assembly 1 comprises two parallel side walls 2*a*, 2*b* spaced apart by a center truss plate 3 (see FIG. 12) that is perpendicular to both side walls 2*a*, 2*b* and connects the two side walls. A center angled bar 18 straddles the center truss plate 3 and extends between the two side walls 2*a*, 2*b*. First and second primary elongated tubes 4 also extend between the two side walls 2*a*, 2*b* on opposing sides of the side walls. The center truss plate 3 and center angled bar 18 are situated in between and parallel to the first and second primary elongated tubes 4. As shown in FIGS. 12 and 13, the first and second primary elongated tubes 4 are on the same horizontal plane. Both of the primary elongated tubes 4 are the same length.

Each primary elongated tube 4 is rotatably connected to a first tube arm 5*a* on a first end of the primary elongated tube 4 and a second tube arm 5*b* on the second end of the primary elongated tube 4. The first and second tube arms 5*a*, 5*b* are each fixedly coupled to a secondary elongated tube 6 that is parallel to the primary elongated tube. The secondary elongated tubes 6 are the same length as each other and longer than the primary elongated tubes 4. The secondary elongated tubes 6 are configured to move relative to the primary elongated tubes 4 while remaining parallel to the primary elongated tubes. The secondary elongated tubes 6 extend longitudinally beyond the side walls; that is, the length of each secondary elongated tube 6 is greater than the distance between the two side walls 2*a*, 2*b*.

Figure 15:
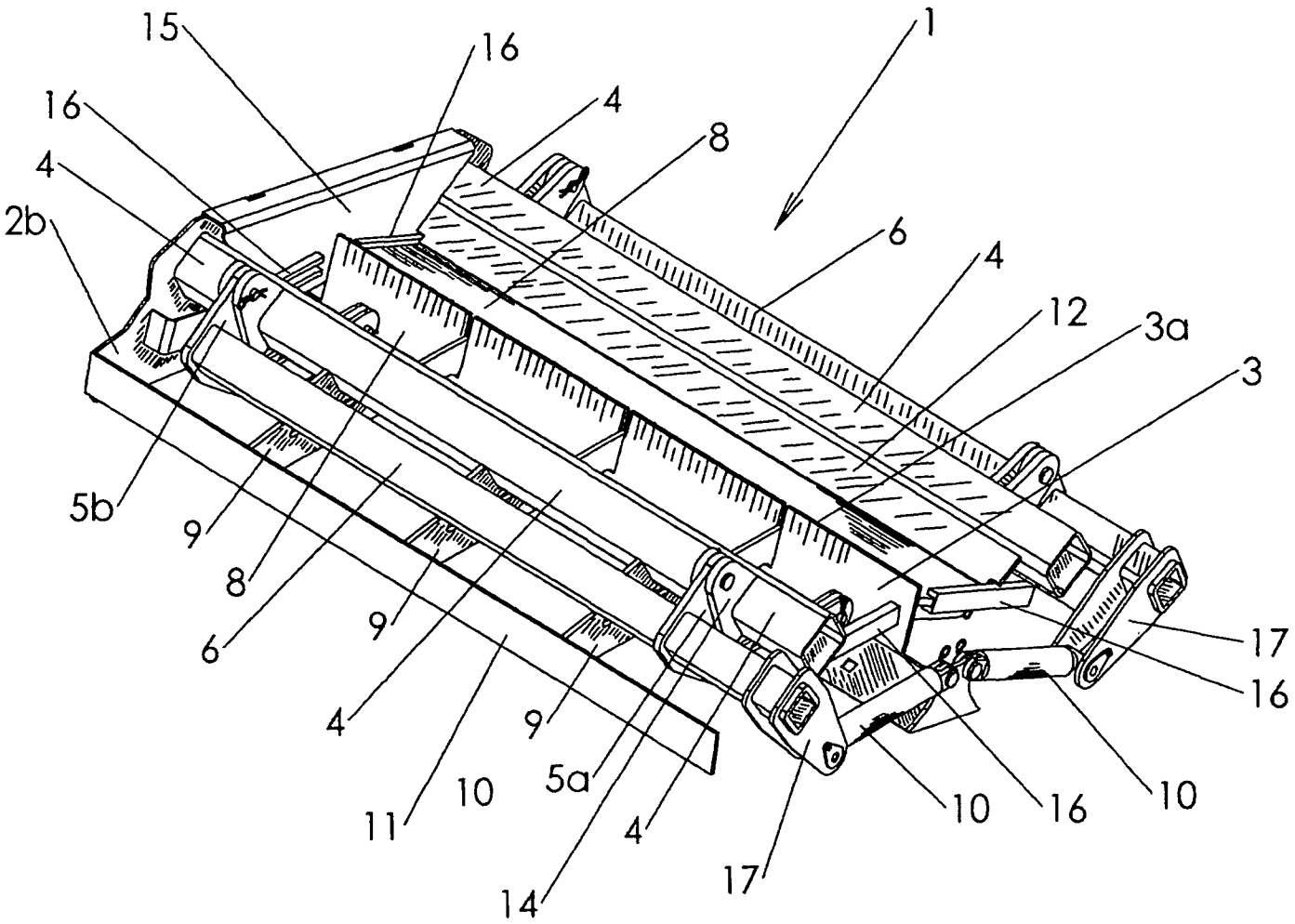
FIG. 15 is a perspective view of the present invention shown with one of the side walls, one of the interior plates, and the door panels removed.

Each tube arm 5*a*, 5*b* is rotatably connected to a door linkage 7 (see FIG. 9) that is situated underneath the door panel 8. Each door linkage 7 is fixedly attached to a door panel 8 that is slidably situated on top of a plurality of trusses 9 that are perpendicular to and extend outwardly from the center truss plate 3 (see FIG. 15, showing that each truss fits into a slot in the center truss plate 3). The trusses 9 are angled downwardly from the center of the truss so that the door panels 8 tilt upward (toward the center) as they rest upon the trusses 9. A first end of each secondary elongated tube 6 is rotatably coupled to a hydraulic cylinder 10 situated on the exterior side of a first side wall 2*a*.

Figure 14:
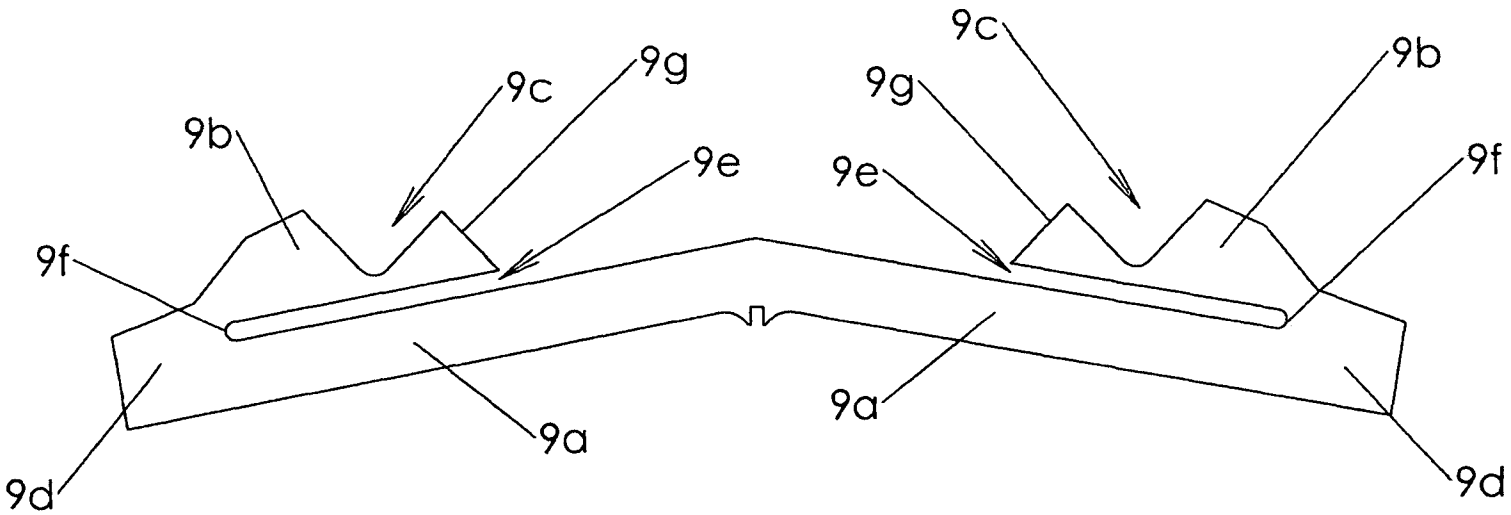
FIG. 14 is an isolated perspective view of a truss.

Each truss 9 is joined at its center to the center truss plate 3 and at its outer ends to an exterior plate 11 that is situated downward of and exterior to the primary elongated tube 4, with the movable secondary elongated arm 6 situated between the primary elongated tube 4 and the exterior plate 11. Each truss 9 is a single piece of metal comprised of two arms, each arm comprising an elongated bottom leg 9*a*, a top leg 9*b* that is shorter than the bottom leg 9*b* and situated on top of the bottom leg 9*a* with a cutout 9*c* configured to receive the primary elongated tube 4, and a joinder section 9*d* that joins the top leg 9*b* to the bottom leg 9*a* (see FIG. 14). The top leg 9*b* extends inwardly from the joinder section 9*d*, which forms the outer end of the truss, and the bottom leg 9*a* is about twice as long as the top leg 9*b*. A slot 9*e* is located between the top leg 9*b* and the bottom leg 9*a* and is configured to receive a door panel 8. The terminal end 9*f* of the slot 9*e* acts as a stop so that the door panel 8 stops sliding further downward (to open the gate) when the outside edge 8*a* of the door panel 8 abuts up against the terminal end 9*f* of the slot 9*e*.

Each of the primary elongated tubes 4 is situated so that a first surface 4*a* and a second surface 4*b* of the tube are at a forty-five-degree (45°) angle relative to a horizontal axis of the invention (see FIG. 13). The second surface 4*b* faces inward (toward the interior of the invention), and the first surface 4*a* faces outward. The first and second surfaces 4*a*, 4*b* are at a ninety-degree (90°) angle relative to each other. An inside slope plate 12 extends downwardly from the bottom edge of the second surface 4*b* at the same angle as the second surface 4*b* and terminates above the bottom legs 9*a* of the trusses 9, creating a gap large enough for the door panel 8 to fit therethrough. The inside slope plate 12 rests against and is supported by the angled edges 9*g* on the top legs 9*b* of the trusses 9. The angled edge 9*g* of the truss is at a forty-five-degree (45°) angle relative to the slot 9*e* and is configured so that when the inside slope plate 12 rests against the angled edge 9*g*, the inside slope plate 12 forms a continuous surface with the inwardly facing second surface 4*b* of the primary elongated tube 4.

A divider assembly 13 is comprised of two flat plates 13*a*, 13*b* extending downwardly from a bottom edge 3*a* of the truss plate 3 and at a one-hundred-thirty-five-degree (135°) angle relative to the vertical axis of the truss plate 3 (see FIG. 12). The truss plate 3 forms the central vertical (and lateral) axis of the gate assembly 1. The flat plates 13*a*, 13*b* act as a surface to which joinder plates (not shown) may be attached so that ballast exiting the gate assembly may be directed accordingly.

Figure 2:
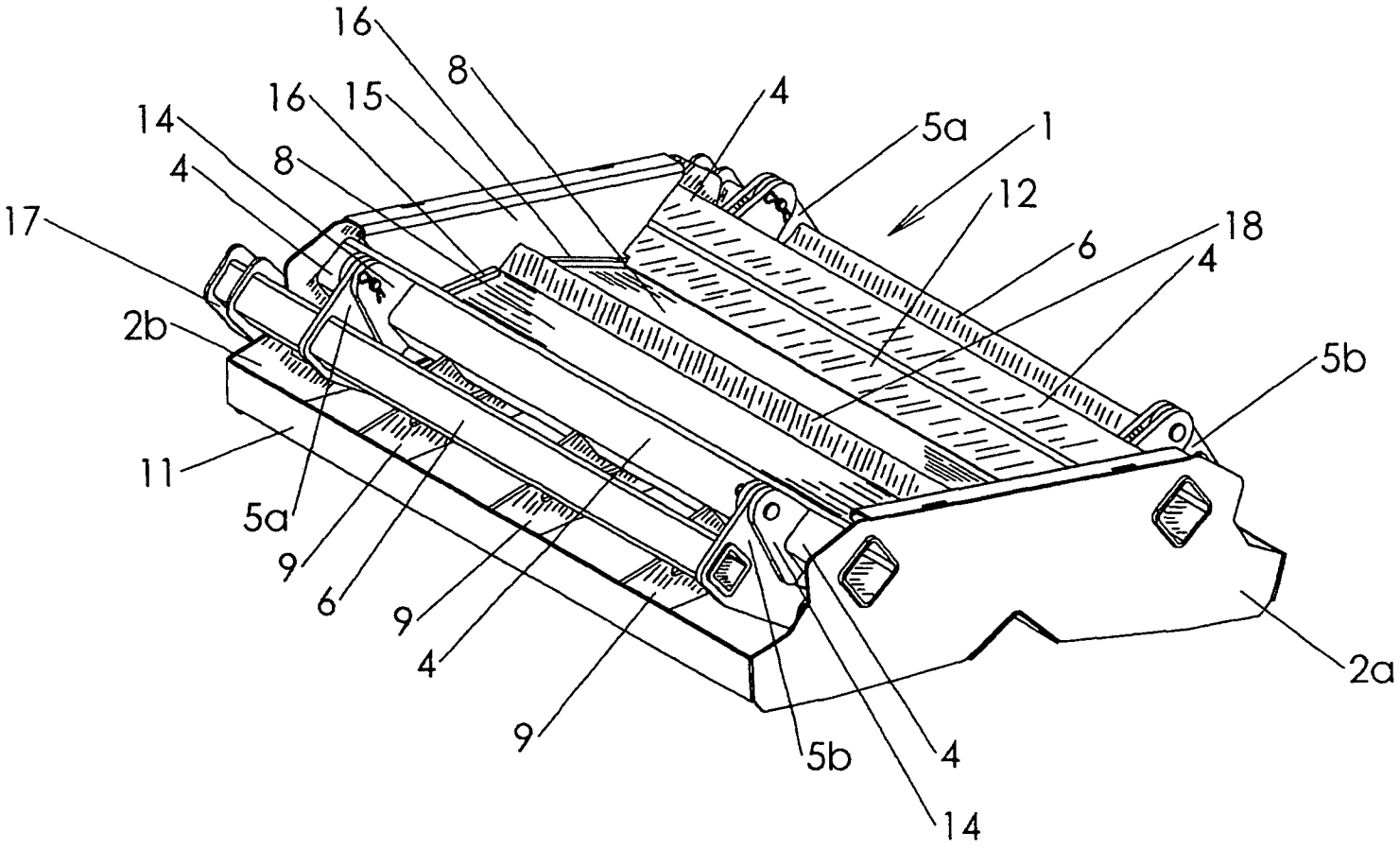
FIG. 2 is a second perspective view of the present invention shown with the gate panels closed.

FIG. 2 is a second perspective view of the present invention shown with the gate panels closed. As shown in this figure, the primary elongated tubes 4 are connected to the tube arms 5 via a pin gusset 14 on either side of the tube arm 5.

Figure 3:
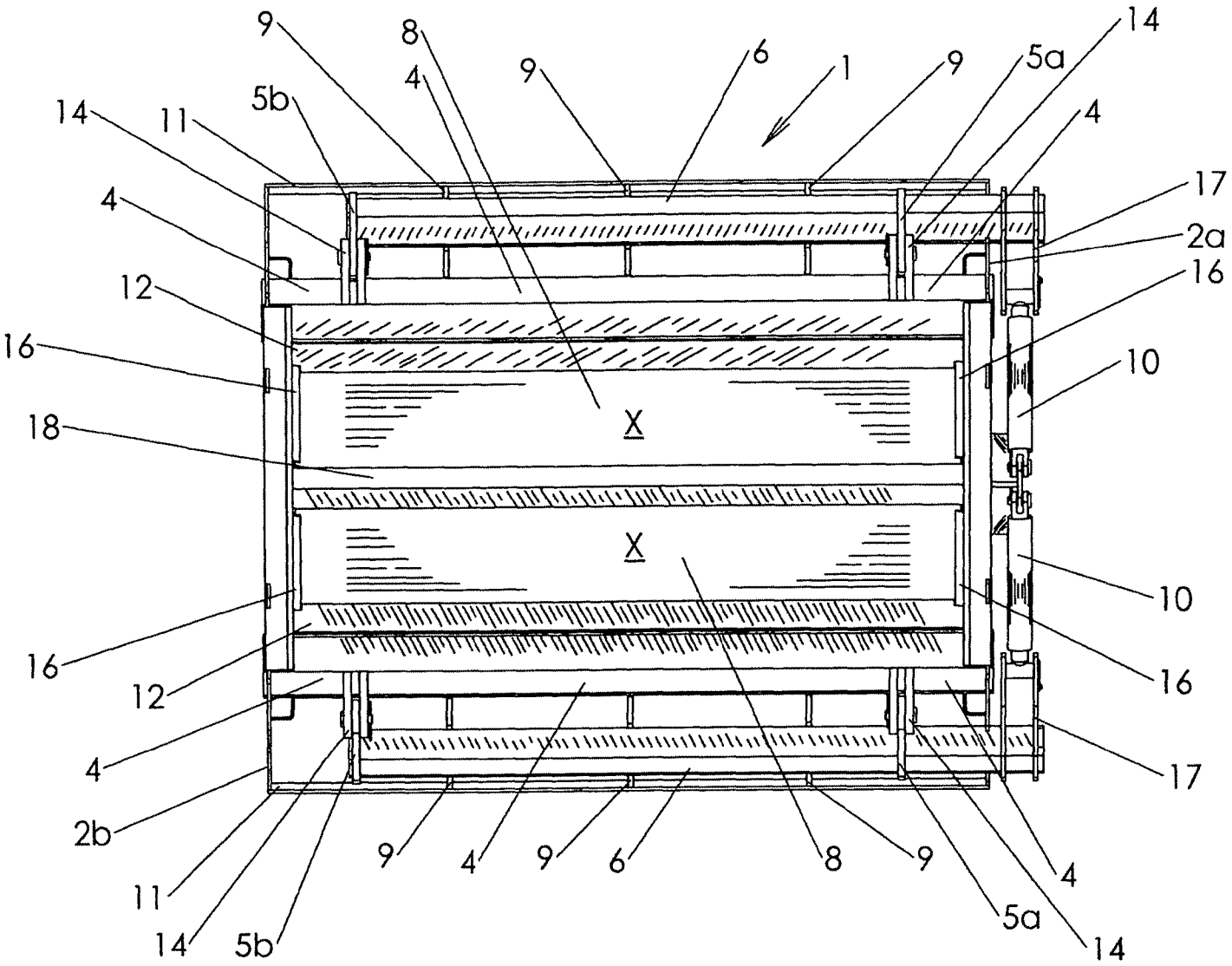
FIG. 3 is a top view of the present invention shown with the gate panels closed.

FIG. 3 is a top view of the present invention shown with the gate panels closed. In operation, the gate assembly 1 is secured to the bottom of a railcar so that ballast in the railcar will flow into the gate assembly and onto the door panels 8 when they are closed. With the door panels closed, the ballast will lie in the areas designated as "X" in this figure.

Figure 4:
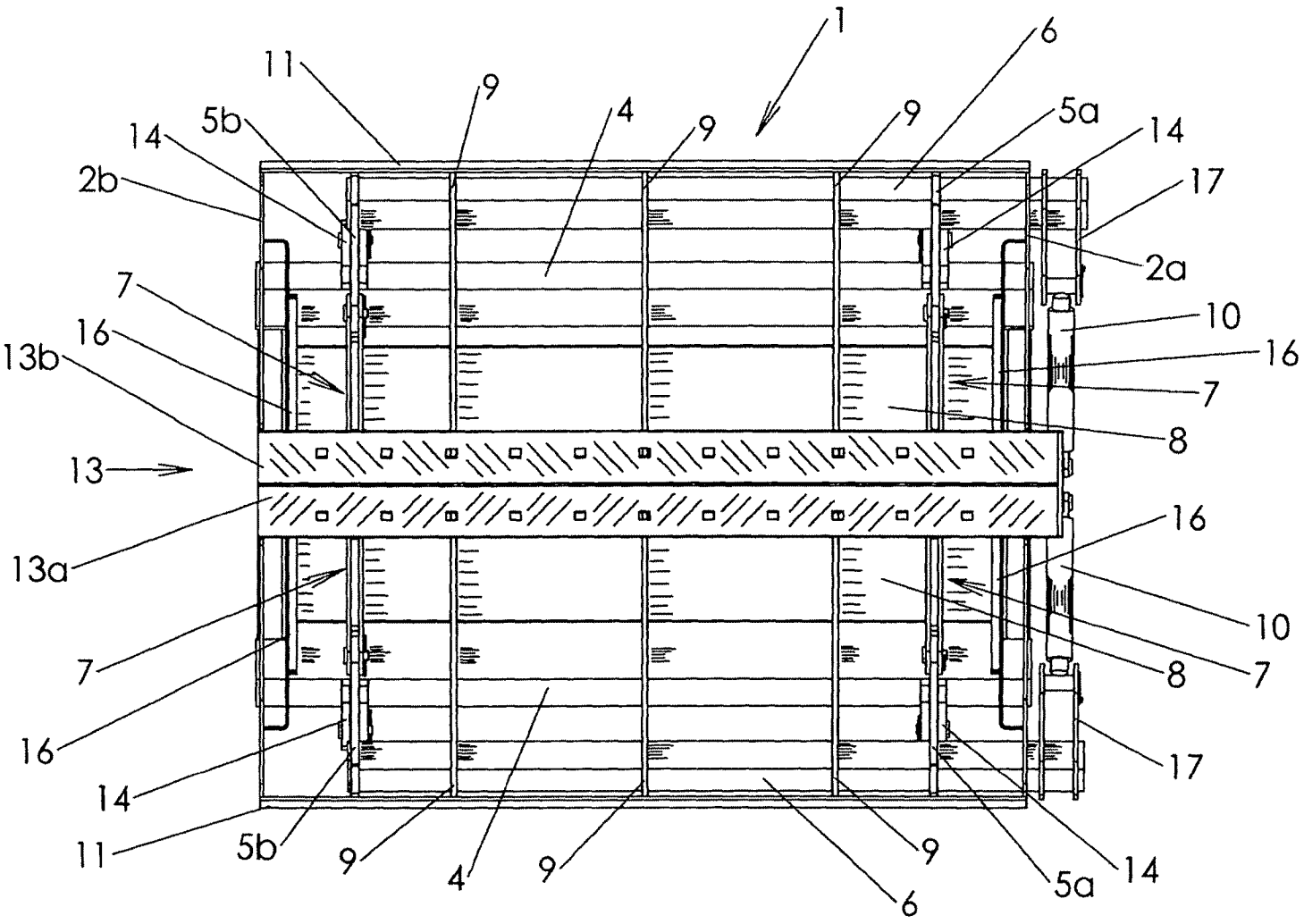
FIG. 4 is a bottom view of the present invention shown with the gate panels closed.

FIG. 4 is a bottom view of the present invention shown with the gate panels closed. As shown in this view, the invention preferably comprises an interior plate 15 spaced apart from and connected to an inner surface of each side wall 2. A pair of door guides 16 is situated on the inner surface of each interior plate and is configured to receive the door panels. The door guides 16 serve to secure the door panels 8 as they move up and down (open and closed) on the trusses 9.

Figure 5:
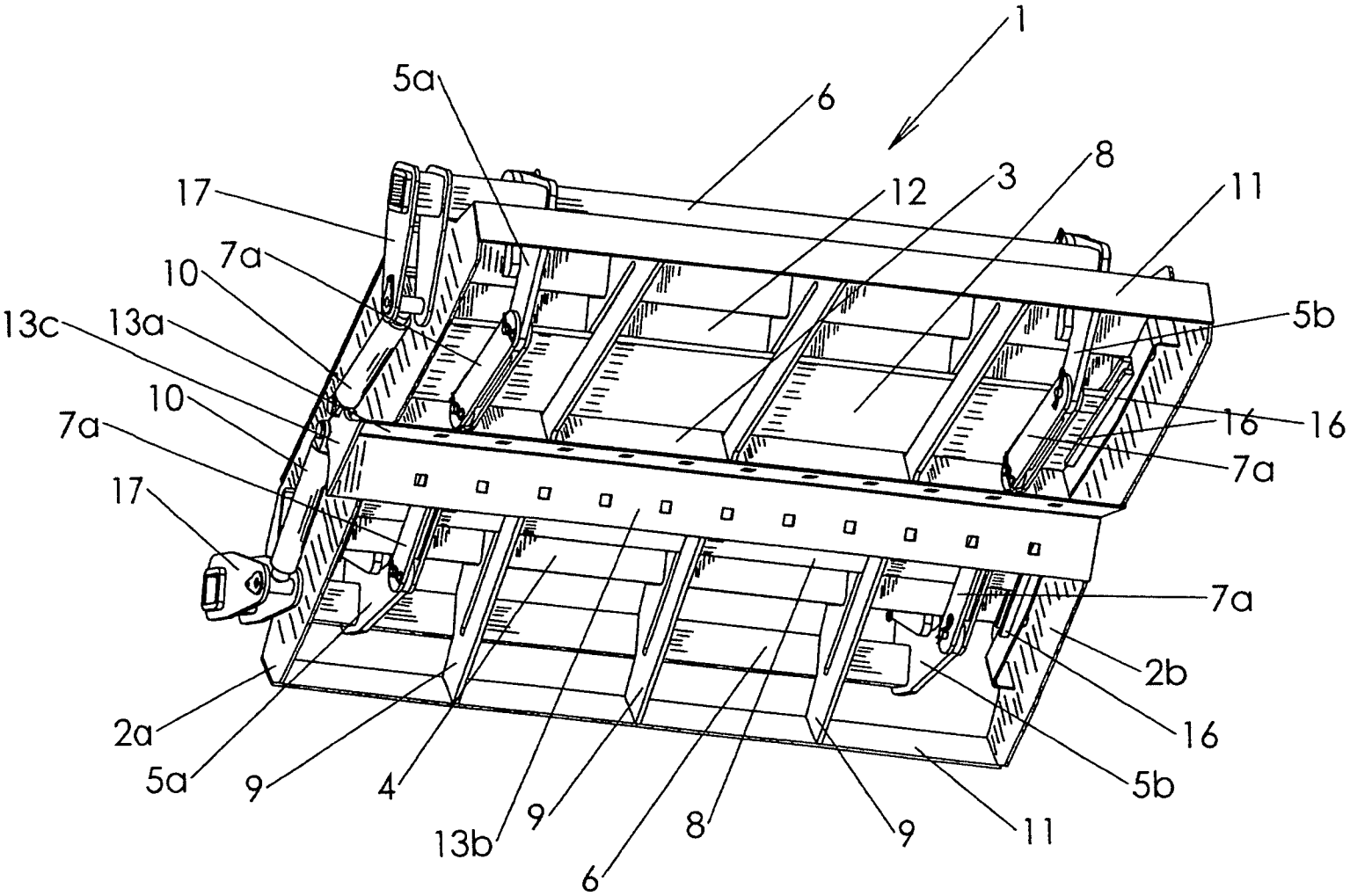
FIG. 5 is a bottom perspective view of the present invention shown with the gate panels closed.

FIG. 5 is a bottom perspective view of the present invention shown with the gate panels closed. As shown in this figure, the divider assembly 13 further comprises an end plate 13*c* on either end of the divider assembly 13. The hydraulic cylinders 10 are attached to one of the end plates 13*c*.

Figure 6:
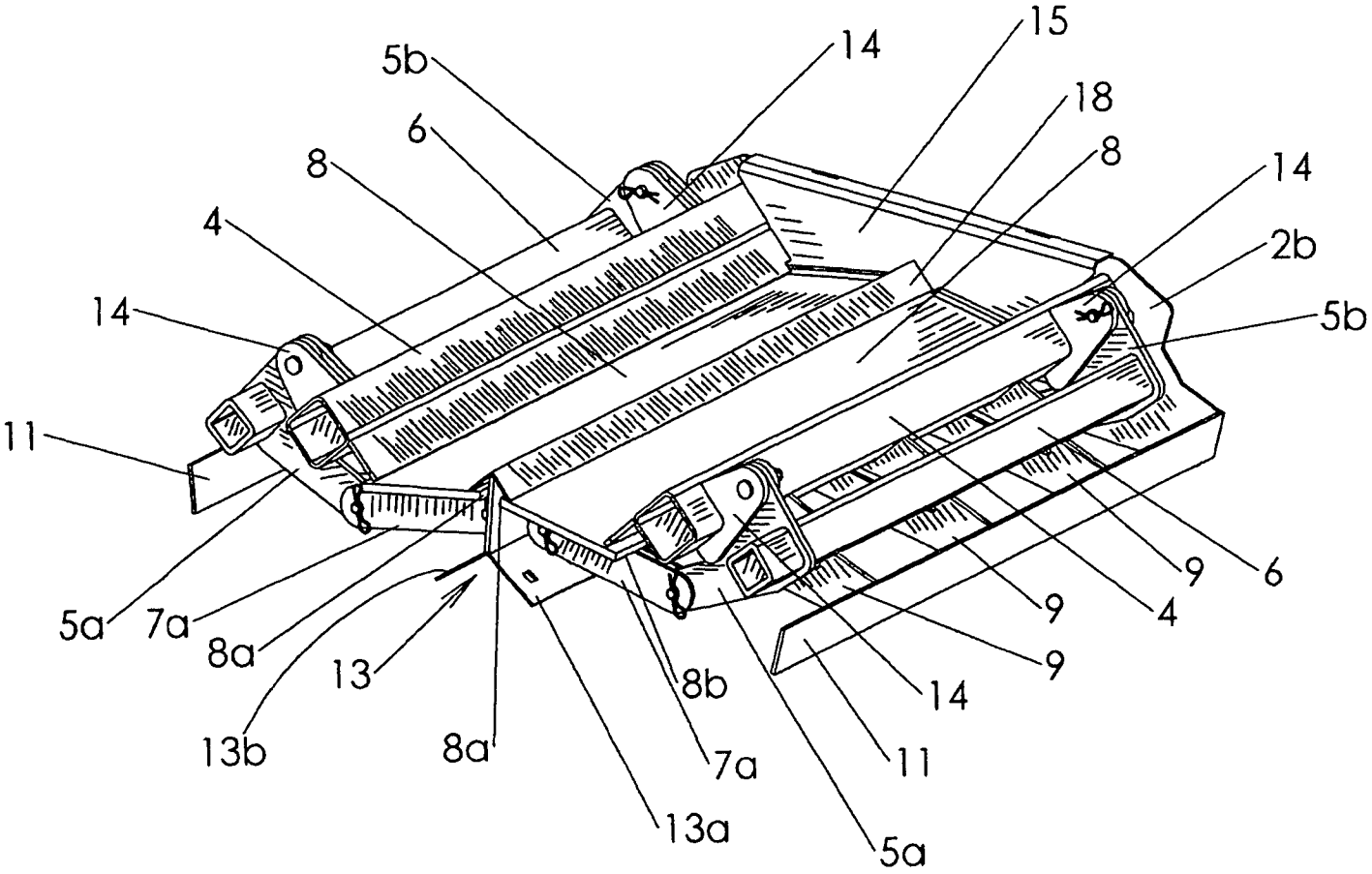
FIG. 6 is a perspective view of the present invention shown with one of the side walls, one of the interior plates, and a pair of door guides removed.

FIG. 6 is a perspective view of the present invention shown with one of the side walls 2, one of the interior plates 15, and a pair of door guides 16 removed. As shown in this figure, when the door panels 8 are in a closed position, the inside edge 8*b* of the door panel fits underneath the center angled bar 3, and the outside edge 8*a* of the door panel 8 fits underneath the inside slope plate 12. The bottom edge 3*a* of the truss plate 3 is connected to the apex of the divider assembly 13 (that is, the point at which the two flat plates 13*a*, 13*b* connect) along the entire length of the flat plates.

Figure 7:
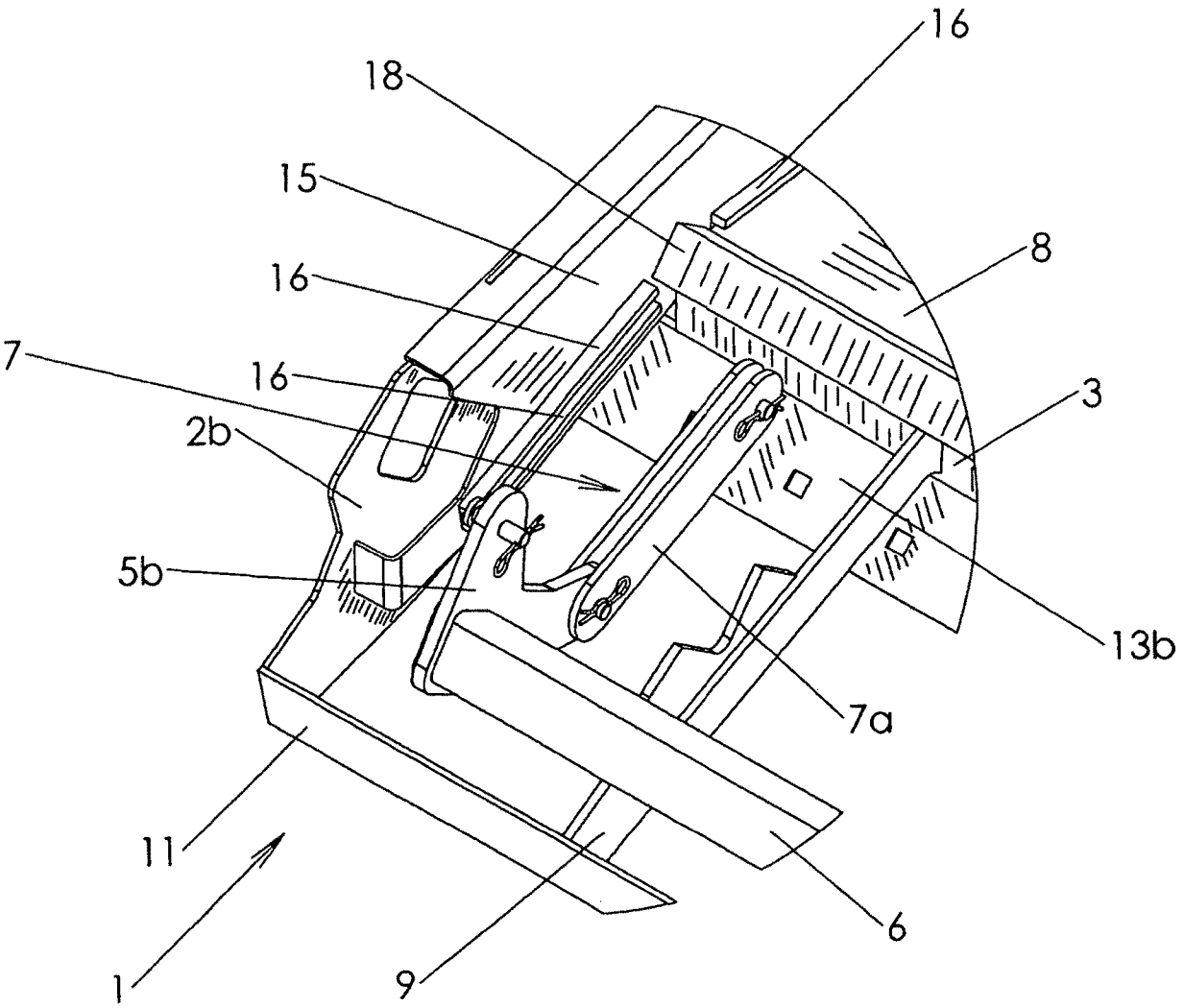
FIG. 7 is a detail view of the mechanical arm assembly of the present invention.

FIG. 7 is a detail view of the mechanical arm assembly of the present invention. As shown in this figure, each door linkage 7 is preferably comprised of a pair of parallel connecting members 7*a*, each of which is connected to one side of the tube arm 5*a*, 5*b* so that there is a connecting member 7*a* on both sides of the tube arm.

Figure 8:
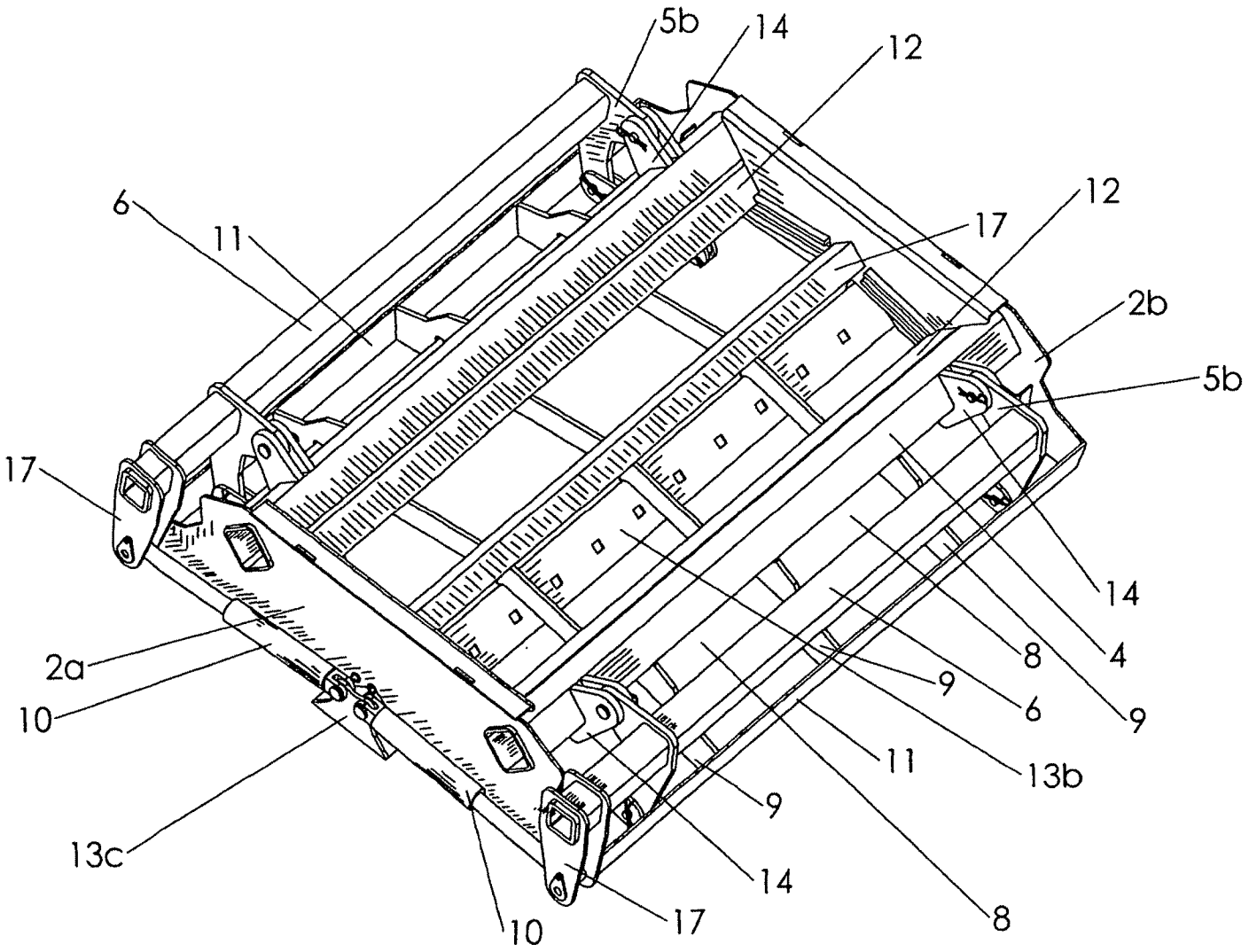
FIG. 8 is a top perspective view of the present invention shown with the gate panels open.
Figure 9:
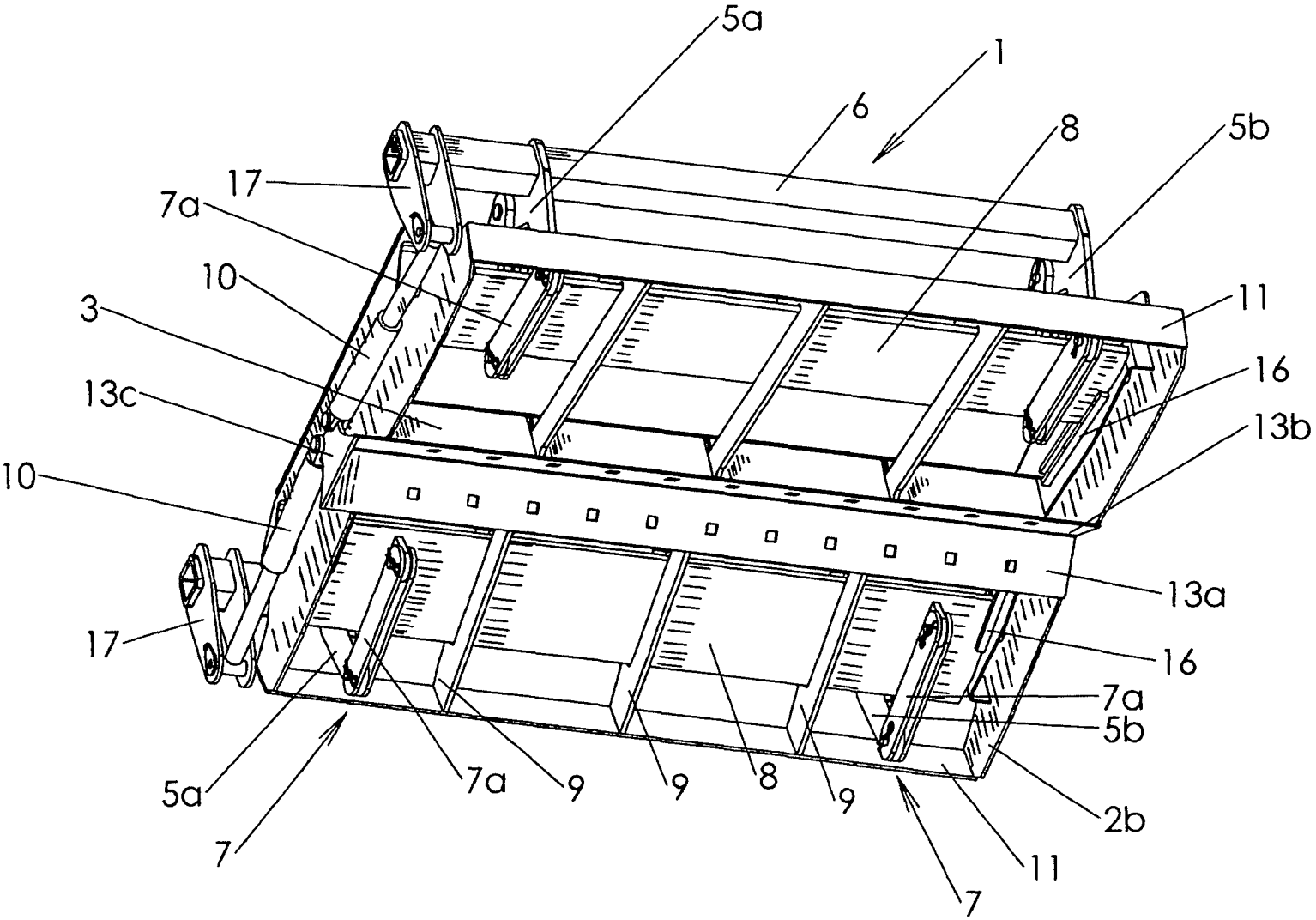
FIG. 9 is a bottom perspective view of the present invention shown with the gate panels open.

FIG. 8 is a top perspective view of the present invention shown with the gate panels open, and FIG. 9 is a bottom perspective view of the present invention shown with the gate panels open. As shown in these figures, each hydraulic cylinder 10 is rotatably attached to the secondary elongated tube 6 via a cylinder arm 17. In operation, as the hydraulic cylinders 10 are extended, the cylinder arms 17 are pushed outward, forcing the secondary elongated tubes 6 upward and the door panels 8 (via the linkages described above) to slide downward (into an open position) on the trusses 9.

Figure 10:
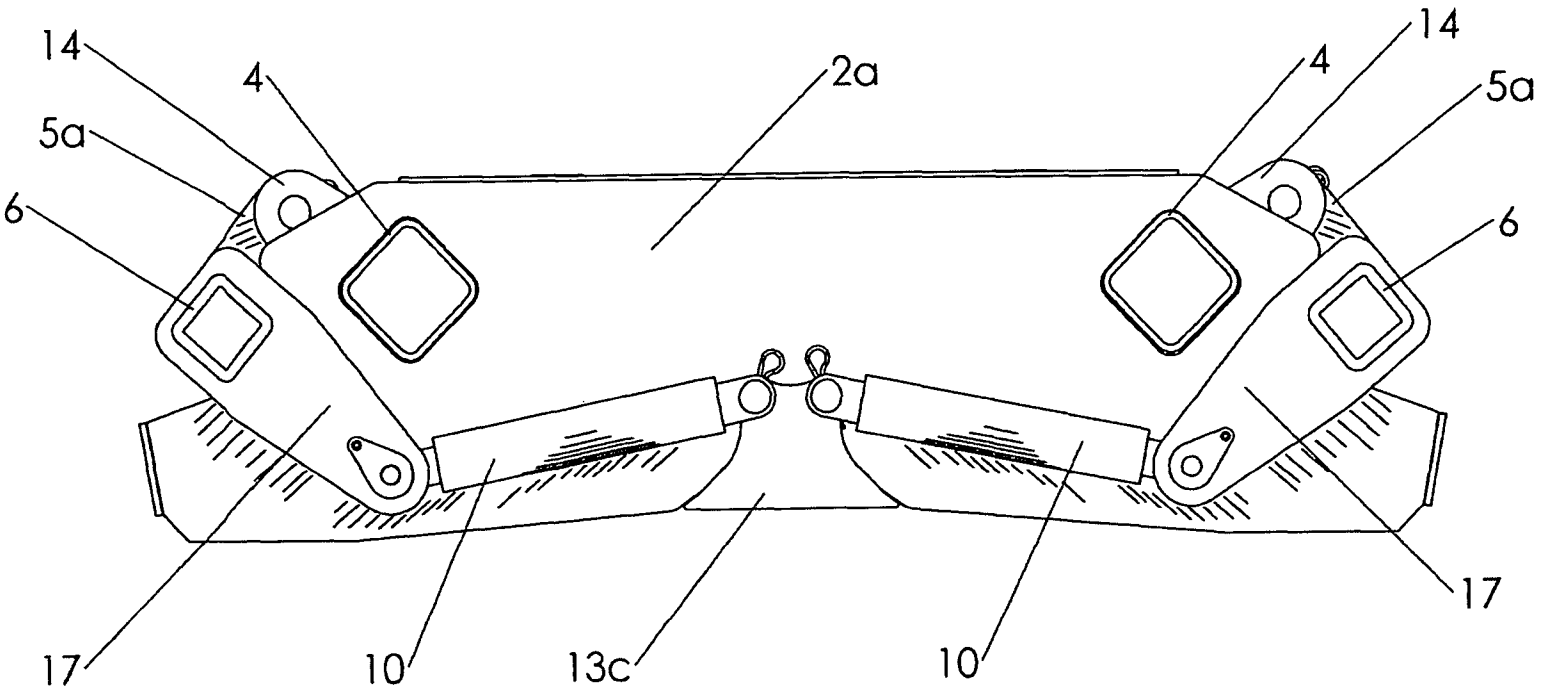
FIG. 10 is a side view of the present invention showing the mechanical arm assembly in a first position.
Figure 11:
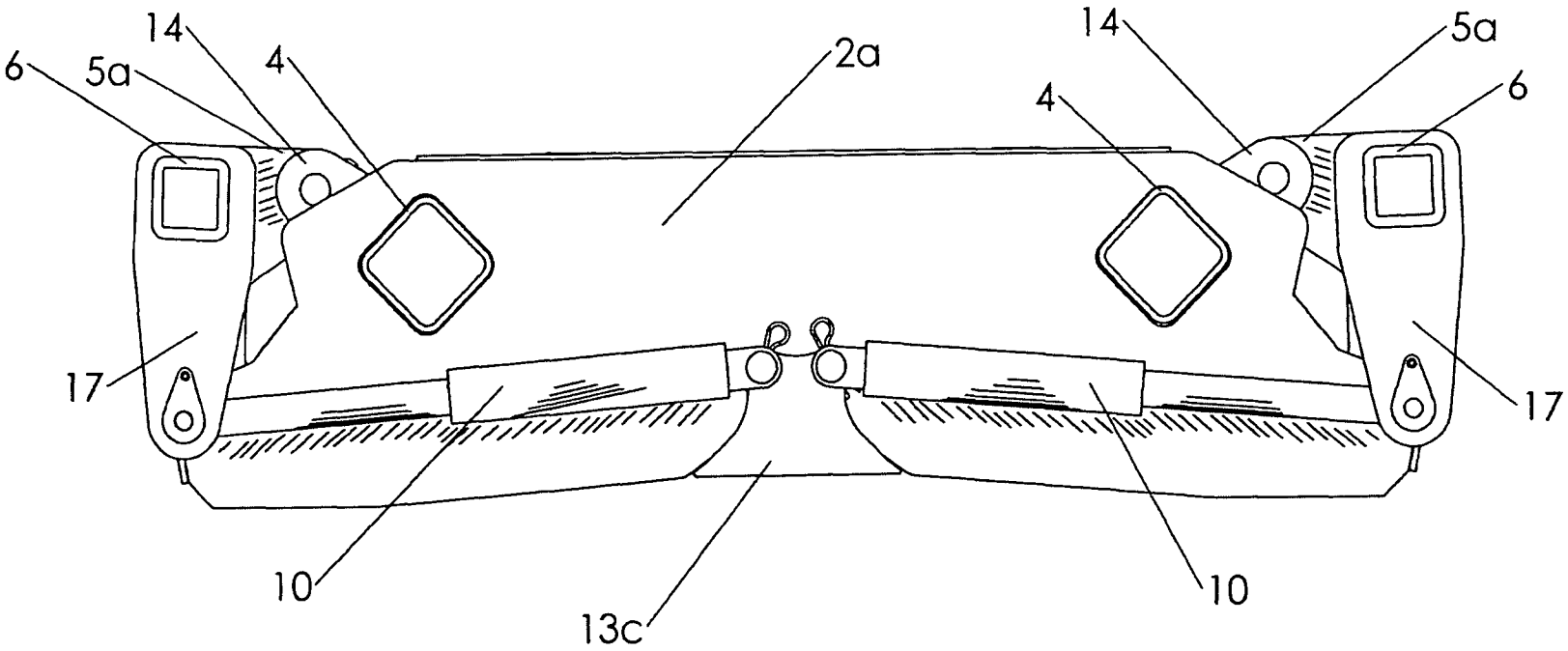
FIG. 11 is a side view of the present invention showing the mechanical arm assembly in a second position.

FIG. 10 is a side view of the present invention showing the mechanical arm assembly in a first position, and FIG. 11 is a side view of the present invention showing the mechanical arm assembly in a second position. In these two figures, the door panels 8 are in an open position in FIG. 10 and a closed position in FIG. 11.

FIG. 12 is a side cross-section view of the present invention showing the mechanical arm assembly in a first position, and FIG. 13 is a side cross-section view of the present invention showing the mechanical arm assembly in a second position. In these two figures, the door panels are in an open position in FIG. 12 and a closed position in FIG. 13.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A railcar ballast delivery gate comprising:

(a) first and second parallel side walls spaced apart by a center truss plate that extends between and is perpendicular to each of the two side walls;

(b) a center angled bar that straddles the center truss plate and extends between the first and second side walls;

(c) first and second primary elongated tubes extending between the first and second side walls on opposing sides of the side walls; and (d) a divider assembly;

wherein the center truss plate and center angled bar are situated in between and parallel to the first and second primary elongated tubes;

wherein the first and second primary elongated tubes are on the same horizontal plane;

wherein the first and second primary elongated tubes each has a length, and the length of the first primary elongated tube is the same as the length of the second primary elongated tube;

wherein each of the first and second primary elongated tubes is rotatably connected to a first tube arm on a first end of the primary elongated tube and rotatably connected to a second tube arm on a second end of the elongated primary tube;

wherein the first tube arm is fixedly coupled to a first secondary elongated tube that is parallel to the first primary elongated tube;

wherein the second tube arm is fixedly coupled to a second secondary elongated tube that is parallel to the second primary elongated tube;

wherein the first and second secondary elongated tubes each has a length, and the length of the first secondary elongated tube is the same as the length of the second secondary elongated tube;

wherein the length of the first and second secondary elongated tubes is greater than the length of the first and second primary elongated tubes;

wherein the first and second secondary elongated tubes are configured to move relative to the first and second primary elongated tubes while remaining parallel to the first and second primary elongated tubes;

wherein each of the first and second tube arms is rotatably connected to a door linkage that is situated underneath and fixedly attached to a door panel;

wherein each of the door panels is slidably situated on top of a plurality of trusses that are perpendicular to and extend outwardly from the center truss plate;

wherein each truss is angled downwardly from a center of the truss so that the door panels tilt upward as they rest upon the plurality of trusses;

wherein a first end of each secondary elongated tube is rotatably coupled to a hydraulic cylinder situated on an exterior side of the first side wall; and wherein each hydraulic cylinder is rotatably attached to one of the first and second secondary elongated tubes via a cylinder arm.

2. The railcar ballast delivery gate of claim 1, wherein each truss is joined at the center of the truss to the center truss plate;

wherein each truss has a first outer end and a second outer end;

wherein the first outer end of each of the trusses is joined to a first exterior plate that is situated downward of and exterior to the first primary elongated tube;

wherein the first secondary elongated arm is situated between the first primary elongated tube and the first exterior plate;

wherein the second outer end of each of the trusses is joined to a second exterior plate that is situated downward of and exterior to the second primary elongated tube; and wherein the second secondary elongated arm is situated between the second primary elongated tube and the second exterior plate.

3. The railcar ballast delivery gate of claim 1, wherein each truss is a single piece of metal comprised of two truss arms;

wherein each truss arm comprises an elongated bottom leg, a top leg that is shorter than the bottom leg and situated on top of the bottom leg with a cutout configured to receive one of the first and second primary elongated tubes, and a joinder section that joins the top leg to the bottom leg;

wherein the top leg extends inwardly from the joinder section;

wherein the joinder section forms an outer end of the truss;

wherein the bottom leg is longer than the top leg;

wherein a slot is located between the top leg and the bottom leg and is configured to receive one of the two door panels; and wherein the slot has a terminal end that is configured to act as a stop to prevent the door panel from sliding further downward when an outside edge of the door panel abuts up against the terminal end of the slot.

4. The railcar ballast delivery gate of claim 3, wherein each of the first and second primary elongated tubes has an outwardly facing first surface and an inwardly facing second surface;

wherein the first surface and the second surface are at a ninety-degree angle relative to each other and at a forty-five-degree angle relative to a horizontal axis of the gate;

wherein a first inside slope plates extends downwardly from a bottom edge of the second surface at the same angle relative to the horizontal axis of the gate as the second surface and terminates above the bottom legs of the plurality of trusses, thereby forming a gap that is configured to receive an outside edge of one of the two door panels;

wherein the slope plate has an inside surface that rests against and is supported by angled edges on the top legs of the plurality of trusses;

wherein the angled edges of the top legs of the trusses are at a forty-five-degree angle relative to the slots in the plurality of trusses; and wherein the inside slope plate is configured to form a continuous surface with the inwardly facing second surface of the first or second primary elongated tube.

5. The railcar ballast delivery gate of claim 1, wherein the divider assembly is comprised of two flat plates extending downwardly from a bottom edge of the center truss plate at a one hundred thirty-five-degree angle relative to a vertical axis of the center truss plate.

6. The railcar ballast delivery gate of claim 1, further comprising first and second interior plates spaced apart from and connected to an inner surface of each of the first and second side walls;

wherein a pair of door guides is situated on an inner surface of each of the first and second interior plates and configured to receive the door panels.

* * * * *